US005206690A

United States Patent [19]

Shimizu et al.

[11] Patent Number: 5,206,690

[45] Date of Patent: Apr. 27, 1993

[54] DEVELOPING ROLLER WITH AN IDENTICAL POLARITY MAGNETIC PART

[75] Inventors: Tamotsu Shimizu, Settsu; Hiroshi Murasaki, Ibaragi; Masahiko Matsuura, Amagasaki; Susumu Mikawa, Itami, all of Japan

[73] Assignee: Minolta Camera Kabushiki Kaisha, Osaka, Japan

[21] Appl. No.: 813,845

[22] Filed: Dec. 27, 1991

[30] Foreign Application Priority Data

Jan. 11, 1991 [JP] Japan ..... 3-1810
Oct. 3, 1991 [JP] Japan ..... 3-255646

[51] Int. Cl.[5] ..... G03G 15/09

[52] U.S. Cl. ..... 355/251; 118/658; 355/259

[58] Field of Search ..... 355/245, 251, 253, 259; 118/656, 657, 658

[56] References Cited

U.S. PATENT DOCUMENTS 3,939,801 2/1976 Tanaka et al. ..... 118/637
4,492,456 1/1985 Haneda et al. ..... 355/253
4,607,933 8/1986 Haneda et al. ..... 355/251 X
4,625,676 12/1986 Sakamoto et al. ..... 118/657
4,780,741 10/1988 Wada et al. ..... 355/253
4,959,692 9/1990 Hayashi et al. ..... 355/253

FOREIGN PATENT DOCUMENTS 60-146276 8/1985 Japan .
60-203975 10/1985 Japan .

*Primary Examiner*—A. T. Grimley
*Assistant Examiner*—Nestor R. Ramirez
*Attorney, Agent, or Firm*—Burns, Doane, Swecker & Mathis

[57] ABSTRACT

A developing device comprises a rotatable developing sleeve, a magnet member stationarily disposed inside the developing sleeve and a developer restricting member which restricts an amount of developer transported on a peripheral surface of the developing sleeve toward a developing region in accordance with rotation of the developing sleeve. The magnet member has a developing magnetic pole confronting the developing region, an identical polarity magnetic part which is provided between the developer restricting member and the developing magnetic pole and is formed of a plurality of adjacent magnetic poles of an identical polarity, and a magnetic pole which is provided between the identical polarity magnetic part and the developing magnetic pole for transporting the developer.

12 Claims, 6 Drawing Sheets

DEVELOPING ROLLER WITH AN IDENTICAL POLARITY MAGNETIC PART

BACKGROUND OF THE INVENTION

1. Field of the Invention

The present invention relates to a developing device in an electrophotographic image forming apparatus such as printers.

2. Description of the Related Art

There have been known various types of developing devices in electrophotographic image forming apparatuses. As a typical example, there has been a developing device, wherein there are provided a magnet member, a developing sleeve rotating around the magnet member and a developer restricting member confronting the developing sleeve, and developer is held on the developing sleeve by a magnetic force of the magnet member and is transported to a developing region by the rotation of the sleeve, while restricting a transportation rate or amount by the restricting member.

In the developing device of this type, clogging often occurs at the restricting member due to causes such as solidification of the developer and/or paper dust, in which case the developer is not transported through the clogged portion, resulting in a void in an image.

For example, the Japanese Laid-Open Patent Publication No.60-146276 has proposed a developing device, in which a magnet member is provided with a magnetic pole portions (forming an identical magnetic polarity part) which are repulsive to each other are disposed between a developer restricting member and a developing magnetic pole of the magnet member.

This developing device of the prior art is designed to correct irregularity in a thickness of a developer layer by flight of the developer at the identical magnetic polarity part in the magnet member, and to prevent the void in the image, which may be caused by the clogging at the restricting member, by filling the void with the flown developer. Naturally, a possibility of the clogging at the restricting member increases as a space between the restricting member and the surface of the developing sleeve decreases.

In the developing device of the prior art, however, the flight of the developer at the identical magnetic polarity part is irregular, so that heights of developer chains are also irregular along an axial direction of the developing sleeve. This causes irregular density in a developed solid image.

SUMMARY OF THE INVENTION

Accordingly, it is an object of the invention to improve a developing device of such a type that includes a magnet member, a developing sleeve rotating around the magnet member and a developer restricting member confronting the developing sleeve, and to provide a developing device in which a void in an image can be prevented, irregularity in a density of the image can be suppressed and a developer supplying rate at the developer restricting member can be stable.

In order to achieve the above object, a developing device according to the invention comprises a rotatable developing sleeve; a magnet member stationarily disposed inside the developing sleeve; and, a developer restricting member which restricts an amount of developer transported on a peripheral surface of the developing sleeve toward a developing region in accordance with rotation of the developing sleeve, the magnet member having a developing magnetic pole confronting the developing region, an identical polarity magnetic part which is provided between the developer restricting member and the developing magnetic pole and is formed of a plurality of adjacent magnetic poles of an identical polarity, and a magnetic pole which is provided between the identical polarity magnetic part and the developing magnetic pole for transporting the developer.

If desired, a developer stirring member may be disposed at a location confronting the identical polarity magnetic part. The developer stirring member may be formed of, e.g., a member which contacts and stirs the developer being transported on the circumferential surface of the developing sleeve toward the developing region, or a member such as a magnet which stirs the developer by an action of a magnetic field without contacting the developer. The stirring member may be located at a position confronting the upstream one of the magnetic poles of the identical polarity magnetic part in the transporting direction of the developer (in a case of a contact type), or at a position confronting the downstream magnetic pole (in a case of a magnetic field type).

The developing magnetic pole may be formed of one magnetic pole, and also may be formed of a plurality of adjacent magnetic poles of an identical polarity.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Embodiments of the invention will be described hereinafter with reference to the drawings.

Figure 1:
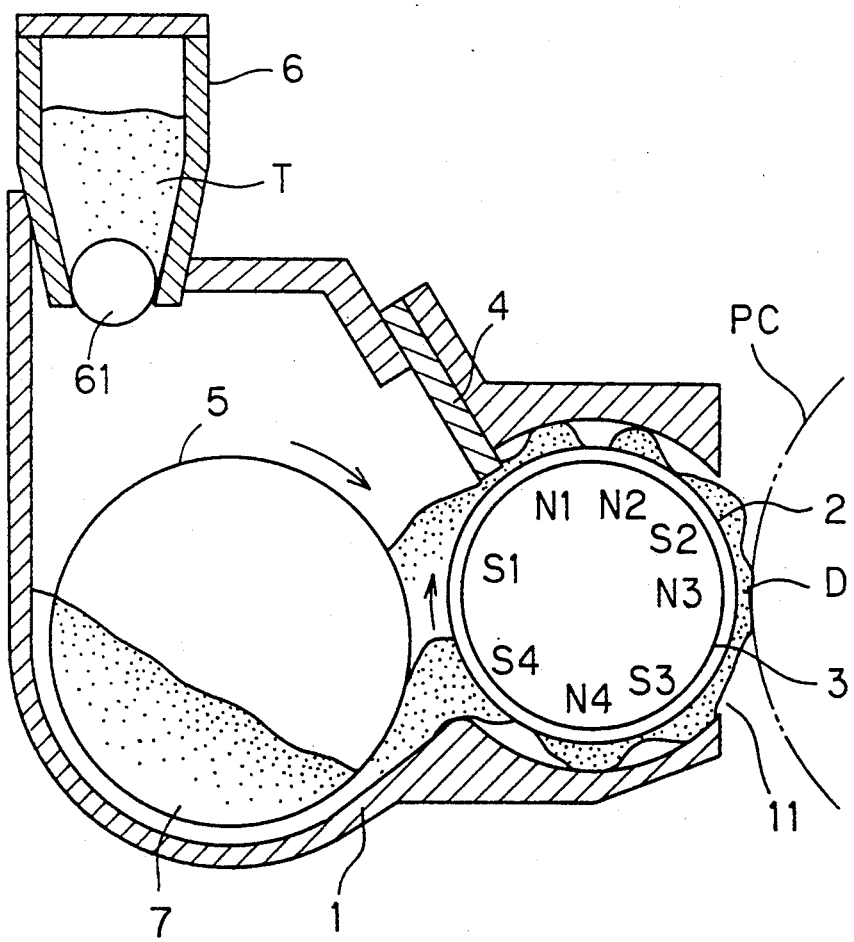
FIG. 1 is a schematic cross section of an embodiment of the invention.
Figure 2:
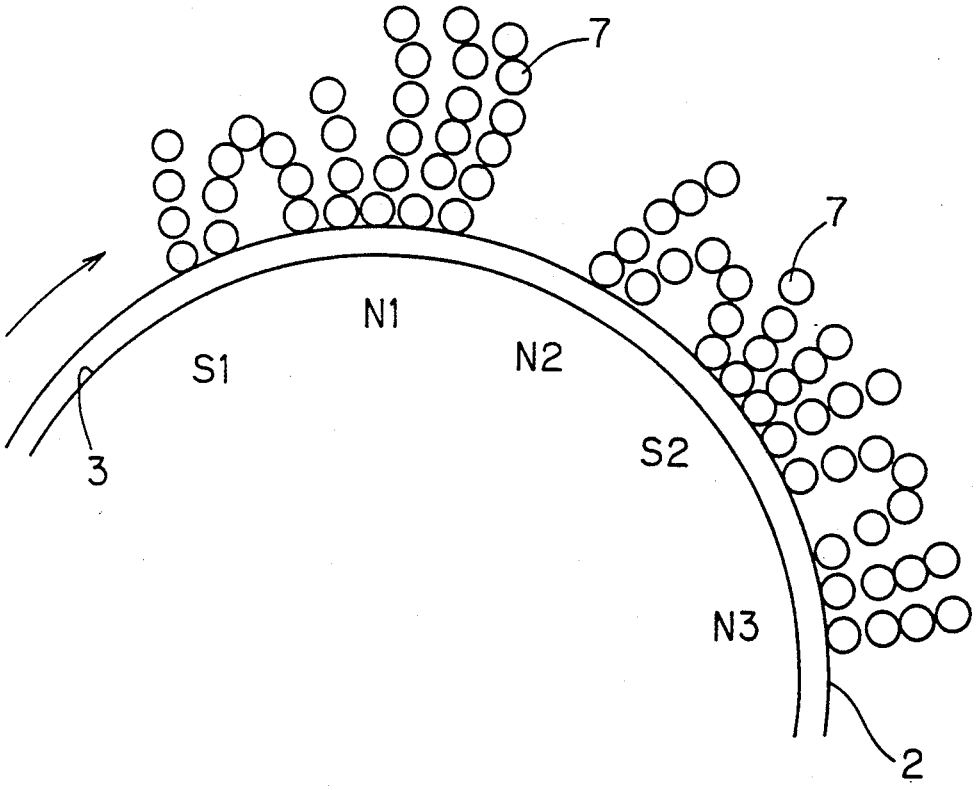
FIG. 2 is a view for illustrating an operation for transporting developer by a magnet member and a developing sleeve in a device in FIG. 1.

FIG. 1 is a schematic cross section of a whole developing device of an embodiment, and FIG. 2 is a view for illustrating an operation for transporting developer by a developing sleeve and a magnet member in the device shown in FIG. 1.

This developing device includes a casing 1, which is provided at its one side with an opening 11 faced to a photosensitive drum PC, i.e., an electrostatic latent image support member in an image forming apparatus.

A portion of the casing 1 provided with the opening 11 rotatably accommodates a developing sleeve 2, which partially confronts the photosensitive drum PC through the casing opening 11. An upper surface of the developing sleeve 2 confronts a developer restricting member, i.e., a developer chain height restricting member 4 supported by the casing 1. The casing 1 accommodates a rotary bucket roller 5 located at a rear side of the developing sleeve 2.

A stationary magnet member 3 is disposed inside the developing sleeve 2. The magnet member 3 includes magnetic poles S1, N1, N2, S2, N3, S3, N4 and S4. The magnetic pole S1 which receives the developer from the bucket roller 5 is located upstream to the restricting member 4, and magnetic poles N1 and N2 of the same polarity are located downstream to the restricting member and upstream to the developing magnetic pole N3. The developer transporting magnetic pole S2 is disposed between the magnetic poles N1 and N2 of the same polarity and the developing magnetic pole N3.

The developing sleeve 2 and the bucket roller 5 are driven to rotate clockwise in FIG. 1 by appropriate drive means (not shown).

A toner hopper 6 is disposed above the bucket roller 5 and is supported by the casing 1. A toner supply roller 61, which is driven to rotate by drive means (not shown), is disposed in a lower opening of the toner hopper 6.

The casing 1 accommodates two-component developer 7 containing carrier and toner. The toner hopper 6 accommodates the toner T for supply.

In this developing device, the drive means (not shown) drives the developing sleeve 2 and the bucket roller 5 to rotate clockwise in FIG. 1, whereby the developer 7 is stirred by the bucket roller 5 and is supplied to the developing sleeve 2.

The developer supplied to the sleeve 2 is held in a form of chains (magnetic brushes) by a magnetic force of the stationary magnet member 3, and is transported to a developing region D in accordance with the rotation of the sleeve.

The restricting member 4 restricts the amount of the developer being transported. The developer which has passed through the restricting member is accumulated on the upstream magnetic pole N1 by the repulsive magnetic fields of the poles N1 and N2 of the same polarity, as shown in FIG. 2, and is stirred in axial and circumferential directions of the developing sleeve. Thus, the developer fills possible voids of the developer which may be caused by solidification of the developer and/or clogging of the paper dust at the restricting member 4. This stirring action also improves a charged state of the toner.

In this manner, the voids in the image which may be caused by the clogging at the restricting member are prevented. If there were a portion on the developing sleeve which was not covered with the developer, the toner would scatter at the uncovered portion when it reached a position downstream to the developing region. However, the illustrated embodiment can prevent the scatter.

Since repulsive magnetic forces of the same polarity do not exist at the location confronting the restricting member 4, fluctuation of the restriction amount of the developer can be prevented.

The restricting member 4 is disposed between the single pole S1 and the upstream one N1 of the poles N1 and N2 of the same polarity, and the line of magnetic force of the pole N1 is forcedly directed toward the pole S1 by the repulsive magnetic field by the pole N2, so that the horizontal magnetic field can be increased. This further stabilizes the developer restricting amount by the restricting member 4 as compared with a case that the member 4 is disposed between the single pole S and a single pole N, and thus the amount is stabilized even when the developing sleeve rotates at a high speed.

The developer accumulated on the magnetic pole N1 flies toward the identical polarity magnetic pole N2 when the magnetic pole N1 comes to such a state that it cannot hold the same any longer. In this operation, the developer flies irregularly with respect to the axial direction of the developing sleeve. However, this irregularity is corrected to some or large extent during the movement toward the developer transportation magnetic pole S2, and the developer chains come to a uniform or nearly uniform state at the developing magnetic pole N3 before being used for the development of the electrostatic latent image on the photosensitive drum PC. In this manner, even a solid image can have a uniform density and a good quality.

The developer 7 which passed through the developing region is further transported downstream by the magnetic forces of the magnetic poles S3 and N4, and then is separated from the sleeve 2 by the centrifugal force of the rotating sleeve 2 and the repulsive magnetic fields between the magnetic poles S4 and S1 of the identical polarity. The separated developer 7 flows into the bucket roller 5.

When the concentration of the toner in the developer contained in the casing 1 reduces, the toner T is supplied by the rotation of the toner supply roller 61 from the toner hopper 6.

The present invention is not restricted to the embodiment described above, and may be embodied in various forms.

For example, the embodiment described above employes the one developer transporting magnetic pole which is disposed between on one hand the magnetic poles N1 and N2 of the identical polarity and on the other hand the developing magnetic pole N3. Two or more developer transporting magnetic poles, however, may be employed.

In order to improve the stirring action for the developer on the pole N1, a leveler and/or stirring member may be associated to the identical polarity magnetic part (N1 and N2), or other magnetic member or magnetic field generating means may also be associated thereto.

Figure 3:
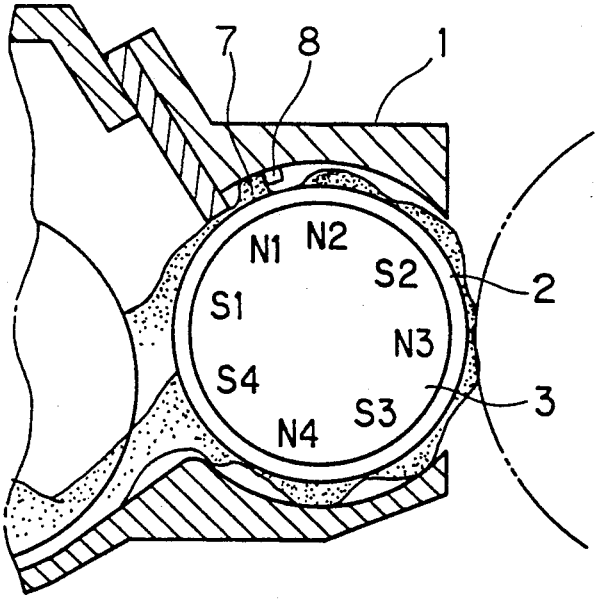
FIG. 3 is a fragmentary cross section of another embodiment.

FIG. 3 shows an embodiment including the developer stirring and leveling member 8, which is carried by the casing 1. The member 8 confronts the upstream pole N1 and is located above the same. The member 8 is disposed to be located substantially on a downstream side surface of the accumulation of developer 7 on the pole N1. The developer is stirred also by the member 8, so that the voids can be prevented more reliably.

Figure 4:
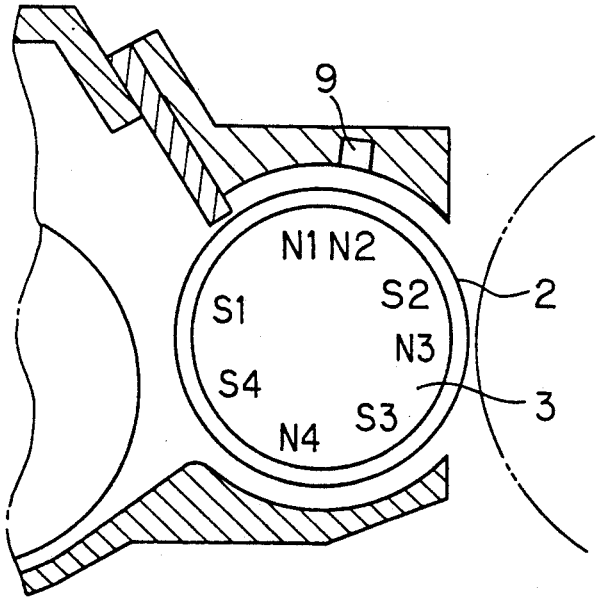
FIG. 4 is a fragmentary cross section of still another embodiment.

FIG. 4 shows an embodiment, in which the stirring member is formed of a magnet 9, which confronts the downstream pole N2 and is carried by the casing 1 such that it is located above the pole N2 and does not touch the developer on the sleeve. The magnet 9 has an N-pole directed toward the pole N2, so that the line of magnetic force generated from the pole N1 tends to return toward the pole S1 owing to the influence of the magnetic fields by the poles N of the magnet 9 and the pole N2. Consequently, the developer on the pole N1 is additionally stirred by the magnet 9, so that the voids can be prevented more reliably.

Figure 5:
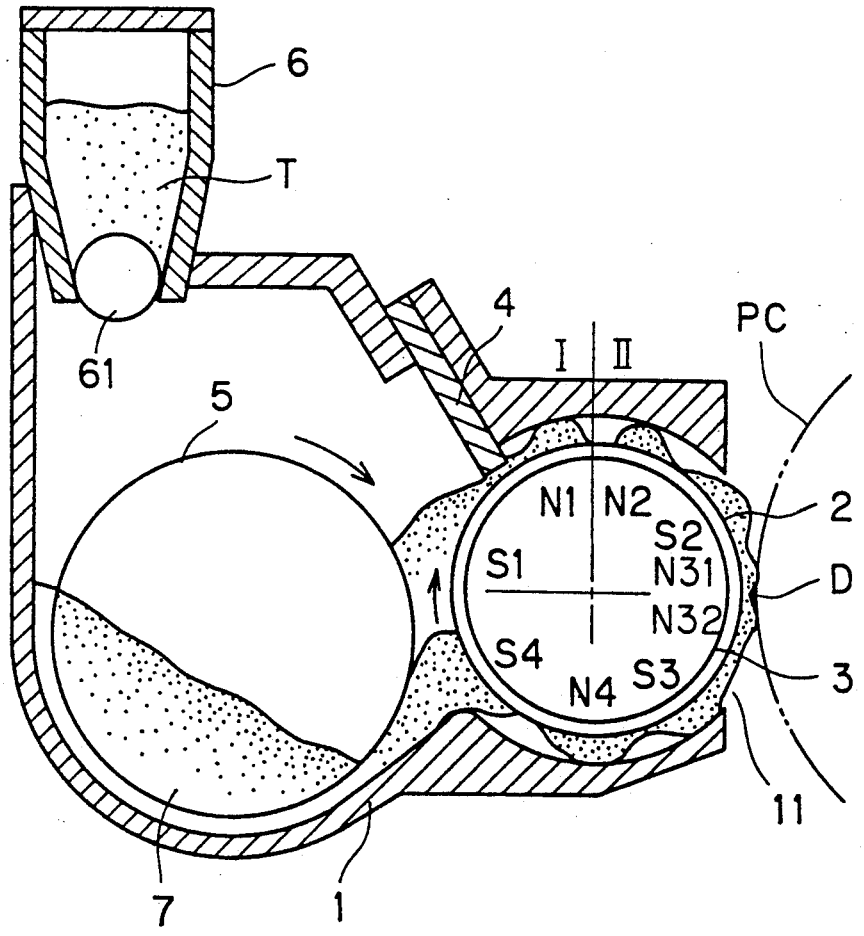
FIG. 5 is a schematic cross section of yet another embodiment.

As shown in FIG. 5, the developing magnetic pole N3 of the magnet member 3 in the developing device shown in FIG. 1 may be replaced with an identical polarity magnetic part formed of magnetic poles N31 and N32 of the same polarity.

This developing magnetic pole formed of the identical polarity magnetic part also stirs the developer, so that the developing performance is further improved, and the voids in the image can be prevented more reliably.

It would be difficult to design a construction of the magnet member described above, in which two identical polarity magnetic parts (N1 and N2) and (N31 and N32) were provided in the one magnet member 3, if the developer transporting pole S2 did not exist between these identical polarity magnetic parts.

Figure 6:
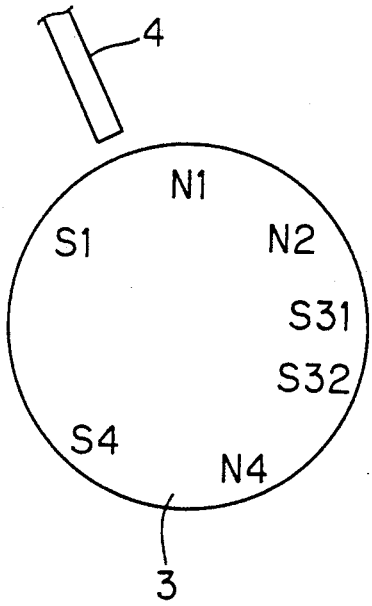
FIG. 6 is a view for illustrating an example of a magnet member in which a developing magnetic pole part is also an identical polarity magnetic part, but does not employ a developer transporting magnetic pole.

That is; if the developer transporting pole S2 were not located therebetween, the magnetic poles N31 and N32 should be changed into two S-poles different from N1 and N2 in order to transport the developer. If they were changed into S31 and S32, as shown in FIG. 6, the magnetic force between the magnetic poles N2 and S31 would be increased because the poles N1 and N2 as well as the poles S31 and S32 had the identical polarities, respectively. However, excessively strong force would cause an excessive accumulation of the developer on the magnetic pole S31, resulting in irregularity in the image. Conversely, an excessively weak force would cause an excessively small accumulation of the developer on the magnetic pole S31, and thus the developing efficiency could not be improved.

Accordingly, in order to take full advantage of the construction in which the developing magnetic pole is formed of the identical polarity magnetic part, the respective identical polarity magnetic parts (N1 and N2) and (S31 and S32) would require high accuracy for obtaining the intended advantages. This would require a high accuracy of, e.g., a space between the identical poles in each identical polarity magnetic part, (said space affecting the magnetic force between N2 and S31). Further, it should take into consideration that one identical polarity magnetic part generating an unstable magnetic force exists adjacent to the other identical polarity magnetic part. Therefore, it would be very difficult to design the magnet member 3. With respect to this matter, as shown in FIG. 5, the single developer transporting pole S2 which can increase the accuracy of the magnetic force is disposed between the two identical polarity magnetic parts N1 and N2, and N31 and N32, so that the developer can be leveled at a location of the same, and the accumulation of the developer at the magnetic pole N31 is stably maintained at a desired state. Therefore, the two identical polarity magnetic parts N1 and N2, and N31 and N32 can be formed relatively roughly, which facilitates the design and manufacturing of the magnet member.

In the developing device in each embodiment described above, the magnetic poles N1 and N2, of which major purpose is to prevent the voids, are preferably disposed in first and second quadrants I and II in the figure (represented in FIG. 5) for sufficiently stirring the developer, and particularly, it is preferable to dispose the same so that the accumulation of the developer at the pole N1 may be formed by the gravity and the magnetic force by the pole N1 and the upstream pole S1.

The lowering of the magnetic force between the poles N1 and N2 is preferably 20% or more of the average magnetic force between the poles N1 and N2 for causing the flight of the developer between these magnetic poles.

Although the embodiments have been described in connection with the two-component developing device, the invention may be applied to developing devices using one-component developer made of magnetic toner.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing device comprising:

a rotatable developing sleeve;

a magnet member stationarily disposed inside said developing sleeve; and a developer restricting member which restricts an amount of developer transported on a peripheral surface of said developing sleeve toward a developing region in accordance with rotation of said developing sleeve, said magnet member having a developing magnetic pole confronting said developing region, an identical polarity magnetic part which is provided downstream between said developer restricting member and said developing magnetic pole and is formed of a plurality of adjacent magnetic poles of identical polarity, said identical polarity magnetic part having the same polarity as the developing magnetic pole, and a transporting magnetic pole which is provided downstream between the identical polarity magnetic part and said developing magnetic pole for transporting the developer and has a polarity opposite to that of the identical polarity magnetic part.

2. A developing device according to claim 1, wherein said developer restricting member is disposed between a magnetic pole disposed upstream to said developer restricting member in a transporting direction of the developer and the upstream one of said magnetic poles of said identical polarity magnetic part in the transporting direction of the developer.

3. A developing device according to claim 1, wherein said developing magnetic pole has a polarity which is identical with those of said magnetic poles of said identical polarity magnetic part and different from a polarity of said transporting magnetic pole.

4. A developing device comprising:

a rotatable developing sleeve;

a magnet member stationarily disposed inside said developing sleeve; and a developer restricting member which restricts an amount of developer transported on a peripheral surface of said developing sleeve toward a developing region in accordance with rotation of said developing sleeve, said magnet member having a developing magnetic pole part which is formed of a plurality of adjacent magnetic poles of identical polarity and confronts said developing region, an identical polarity magnetic part which is provided between said developer restricting member and said developing magnetic pole part and is formed of a plurality of adjacent magnetic poles of an identical polarity, said identical polarity magnetic part has the same polarity as the developing magnetic pole part, and a transporting magnetic pole which is provided between said identical polarity magnetic part and said developing magnetic pole part for transporting the developer and has a polarity opposite to that of the identical polarity magnetic part.

5. A developing device according to claim 4, wherein said developer restricting member is disposed between a magnetic pole disposed upstream to said developer restricting member in a transporting direction of the developer and the upstream one of said magnetic poles of said identical polarity magnetic part in the transporting direction of the developer.

6. A developing device according to claim 4, wherein said developing magnetic pole part has a polarity which is identical with those of said magnetic poles of said identical polarity magnetic part and is different from a polarity of said transporting magnetic pole.

7. A developing device comprising:

a rotatable developing sleeve;

a developer restricting member which restricts an amount of developer transported on a peripheral surface of said developing sleeve toward a developing region in accordance with rotation of said developing sleeve;

a magnet member stationarily disposed inside said developing sleeve, said magnet member having a developing magnetic pole confronting said developing region, an identical polarity magnetic part which is provided between said developer restricting member and said developing magnetic pole and is formed of a plurality of adjacent magnetic poles having identical polarity; and a transporting magnetic pole which is provided between said identical polarity magnetic part and said developing magnetic pole for transporting the developer; and a developer stirring member which is disposed at a location confronting said identical polarity magnetic part, and contacts the developer being transported on an outer peripheral surface of said developing sleeve toward said developing region for stirring the same.

8. A developing device according to claim 7, wherein said stirring member is disposed to confront the upstream magnetic one of said magnetic poles of said identical polarity magnetic part in a transporting direction of the developer.

9. A developing device according to claim 8, wherein said developer restricting member is disposed between a magnetic pole disposed upstream to said developer restricting member in a transporting direction of the developer and the upstream one of said magnetic poles of said identical polarity magnetic part in the transporting direction of the developer.

10. A developing device comprising:

a rotatable developing sleeve;

a developer restricting member which restricts an amount of developer transported on a peripheral surface of said developing sleeve toward a developing region in accordance with rotation of said developing sleeve;

a magnet member stationarily disposed inside said developing sleeve, said magnet member having a developing magnetic pole confronting said developing region, an identical polarity magnetic part which is provided between said developer restricting member and said developing magnetic pole and is formed of a plurality of adjacent magnetic poles having identical polarity, and a transporting magnetic pole which is provided between said identical polarity magnetic part and said developing magnetic pole for transporting the developer; and a developer stirring member which is disposed at a location confronting said identical polarity magnetic part and is spaced from said developer, and applies a magnetic field to stir the developer being transported on an outer peripheral surface of said developing sleeve toward said developing region.

11. A developing device according to claim 10, wherein said stirring member is a magnet, which is disposed to confront the downstream one of said magnetic poles of said identical polarity magnetic part in a transporting direction of the developer and has a polarity identical with those of said magnet poles of said identical polarity magnetic part.

12. A developing device according to claim 11, wherein said developer restricting member is disposed between a magnetic pole disposed upstream to said developer restricting member in a transporting direction of the developer and the upstream one of said magnetic poles of said identical polarity magnetic part in the transporting direction of the developer.

* * * * *